United States Patent [19]

Nania

[11] Patent Number: 4,965,970

[45] Date of Patent: Oct. 30, 1990

[54] PREFABRICATED DOME-SHAPED STRUCTURE

[75] Inventor: Daniela Nania, Marsala, Italy

[73] Assignee: Dynatherm Systems U.S.A. Ltd., Portsmouth, Va.

[21] Appl. No.: 262,901

[22] Filed: Oct. 25, 1988

[30] Foreign Application Priority Data

Jan. 19, 1988 [IT] Italy ..... 2467/88[U]

[51] Int. Cl.[5] ..... E04B 1/32

[52] U.S. Cl. ..... 52/82; 52/247; 52/396; 52/582

[58] Field of Search ..... 52/80, 586, 583, 264, 52/284, 293, 247, 396, 82, 80, 582, 578

[56] References Cited

U.S. PATENT DOCUMENTS

| | | | |
|---|---|---|---|
| 1,813,909 | 7/1931 | Brainard et al. | 52/293 X |
| 1,853,803 | 4/1932 | Dreisel | 52/262 |
| 3,230,683 | 1/1966 | Foster | 52/583 X |
| 3,284,969 | 11/1966 | Walters et al. | 52/80 |
| 3,400,958 | 9/1968 | Haimes . | |
| 3,420,016 | 1/1969 | Findlay | 52/293 X |
| 3,562,975 | 2/1971 | Moss . | |
| 3,671,006 | 1/1972 | Berkowitz . | |
| 3,729,889 | 5/1973 | Baruzzini | 52/586 |
| 3,763,608 | 4/1971 | Chamlee . | |
| 3,785,103 | 1/1974 | Turner . | |
| 3,996,714 | 12/1976 | Hazelett, Jr. | 52/583 X |
| 3,999,337 | 12/1976 | Tomasetti, Jr. . | |
| 4,023,317 | 5/1977 | Bettger . | |
| 4,044,511 | 8/1977 | Lingle . | |
| 4,068,437 | 1/1978 | Byxbe . | |
| 4,077,177 | 3/1978 | Boothroyd . | |
| 4,599,841 | 7/1986 | Haid | 52/586 X |
| 4,655,013 | 4/1987 | Ritland . | |
| 4,676,038 | 6/1987 | Doyon et al. | 52/586 X |
| 4,686,804 | 8/1987 | Smith | 52/80 X |

FOREIGN PATENT DOCUMENTS

| | | |
|---|---|---|
| 625089 | 9/1961 | Italy . |
| 168694 | 8/1978 | Italy . |

*Primary Examiner*—James L. Ridgill, Jr.
*Attorney, Agent, or Firm*—Gottlieb, Rackman & Reisman

[57] ABSTRACT

A prefabricated building structure having a dome-shaped configuration and which is made from a plurality of insulating panels is described. Adjacent panels are connected together by means of a locking device and supporting gasket located at the edges of adjacent panels.

14 Claims, 2 Drawing Sheets

PREFABRICATED DOME-SHAPED STRUCTURE

BACKGROUND OF THE INVENTION

This invention relates to a prefabricated modular building which is formed from a plurality of interconnected panels, and more particularly to a prefabricated dome-shaped structure formed from a plurality of sections made from a highly insulative material.

Because of natural or man-made disasters, such as hurricanes, volcanic eruptions, fires and the like, suitable housing which can be easily and quickly constructed is necessary for victims of these disasters. In addition, many remote areas throughout the world are lacking in the materials necessary for constructing habitable space.

Furthermore, there is need for utility or storage structures for the home which can be easily and quickly assembled by the homeowner.

Consequently, in view of the above needs, it is clear that a prefabricated modular building which may be easily and quickly assembled from light weight components and which is suitable for withstanding harsh environmental conditions is desirable.

Although prefabricated building structures, such as dome-shaped buildings, are known to exist, conventional prefabricated structures have a number of disadvantages. Although prefabricated domed structures of the prior art are more simple to assemble than traditional brick and wood frame residential dwellings, prior art structures usually require the initial assembly of an appropriate construction site, which hinders the speed at which the dome-shaped structure is assembled.

Furthermore, with most prior art structures, it is necessary to cover the outside of the structure with a cement coating. However, if weather conditions are adverse, it may not be possible to apply the cement coating, thereby hindering the overall completion of the assembly.

Accordingly, it is desirable to provide a prefabricated building which overcomes the above disadvantages, which may be assembled without complicated or expensive equipment and tools, and which is habitable in both warm and cold climatic conditions.

SUMMARY OF THE INVENTION

Generally speaking, in accordance with the invention, a novel prefabricated building structure of a dome-shaped configuration which may be easily assembled from a plurality of lightweight insulating panels is provided. Each of the insulating panels may be connected to the adjacent panels by a suitable locking device. In particular, the edges of a first panel are connected to the corresponding edge of a second adjacent panel by a screw-locking or clamping device and a supporting gasket. The gasket is located in a chamber defined by the edges of two panels when the edges are in contact.

Accordingly, it is an object of the invention to provide an improved prefabricated building structure.

It is another object of the invention to provide an improved prefabricated structure which may be easily assembled and disassembled.

Still another object of the invention is to provide a improved prefabricated building structure which avoids the independent construction of a building site.

Yet a further object of the invention is to provide a prefabricated structure which is suitable for use in various climatic conditions.

Another object of the invention is to provide an improved prefabricated structure which can withstand various environmental conditions.

Still other objects and advantages of the invention will in part be obvious and will in part be apparent from the following description.

The invention accordingly comprises the assembly embodying the features of construction, combination of elements and arrangement of parts as exemplified in the following detailed description, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
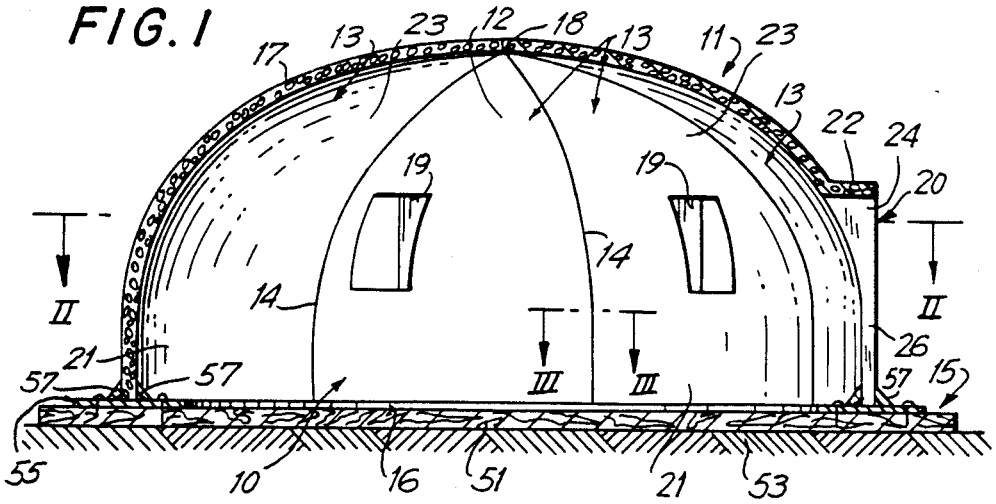
FIG. 1 is a side view in cross-section showing a prefabricated building assembly in accordance with the invention.

Referring first to Fig. 1, a prefabricated building assembly in accordance with the invention is generally indicated at 11, and includes a plurality of interconnected panels or sections 13. Each panel or section 13 is constructed of an insulating material 17 and includes side edges 14 and a curved bottom edge 16. In assembly, as described in more detail below, corresponding side edges 14 of adjacent panels 13 are connected in order to construct assembly 11, which has a dome-shaped configuration. Each of panels 13 includes a lower portion 10 and a continuous upper portion 12 having a tip 18. Each of tips 18 of panels 13 meet at a common point along the upper most part of assembly 11 when assembled, as depicted in FIG. 1.

Figure 2:
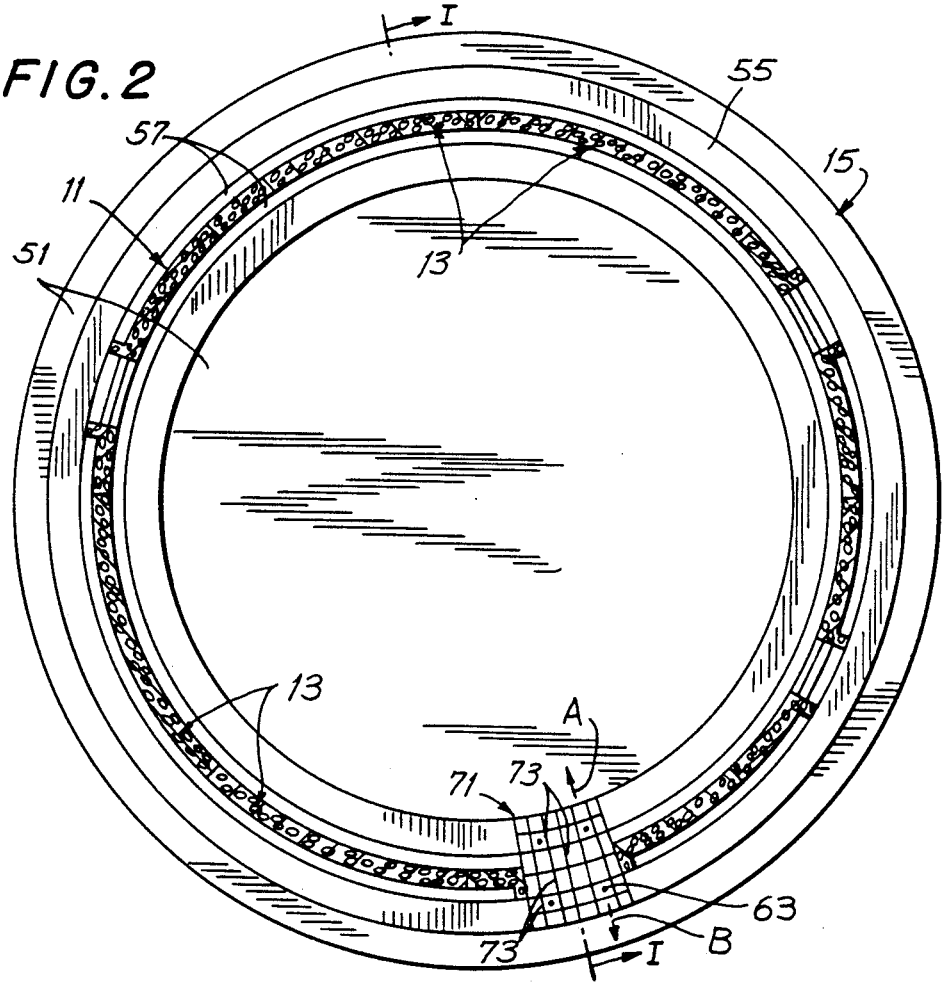
Fig. 2 is a cross-sectional view taken along line 2—2 of FIG. 1.

Referring now to FIG. 2 as well as to FIG. 1, one of panels 13 includes an integrally formed doorway 20 extending outwardly therefrom. Doorway 20 includes a flat roof 22 and a pair of side walls 24 which define an access region 26 suitable for enabling an individual to enter the interior of prefabricated assembly 11. Doorway 20 may also include (for a temporary assembly) a floor 71 having a plurality of ribs 73 formed thereon in order to prevent an individual from slipping due to water or ice conditions on floor 71 of doorway 20.

Panels 13 may also include a window or opening 19.

Prefabricated assembly 11 is mounted on a base assembly generally indicated at 15 which, as described in more detail below, supports panels 13 in a substantially upright position.

Figure 3:
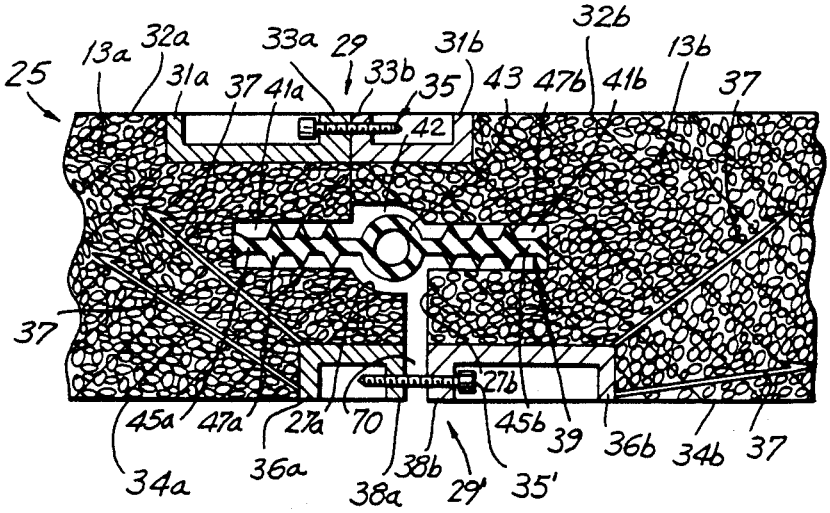
Fig. 3 is an enlarged cross-sectional view taken along line 3—of FIG. 1 and showing how adjacent panels of the assembly are connected.

Referring now to FIG. 3, a mechanism for connecting adjacent panels 13 of assembly 11 in accordance with the invention is described and is generally indicated at 25. Connecting mechanism 25 comprises a first clamping device generally indicated at 29 and a second clamping device generally indicated at 29'. Clamping devices 29 and 29, enable adjacent panels 13*a* and 13*b* of assembly 11 to be connected, as described in more detail below.

Adjacent panels 13*a* and 13*b* include edge portions 27*a* and 27*b* respectively, of which a part thereof are in contact. Panels 13*a* and 13*b* also include outer surfaces 32*a* and 32*b* and inner surfaces 34*a* and 34*b* respectively.

Panel 13*a* further includes an outer metallic shell 31*a* and an inner metallic shell 36*a*. Similarly, panel 13*b* includes an outer metallic shell 31*b* and an inner metallic shell 36*b*. Shell 31*a* of panel 13*a* includes a forward flange 33*a* which retains a first screw 35. Shell 31*b* of panel 13*b* also includes a forward flange 33*b* which faces flange 33*a* of shell 31*a* and receives therein screw 35 when panels 13*a* and 13*b* are connected, as shown in FIG. 3.

Shell 36*b* of panel 13*b* includes a forward flange 38*b* which retains a second screw 35, Shell 36*a* of panel 13*a* also includes a forward flange 38*a* which faces flange 38*b* of shell 36*b* and receives therein screw 35, when panels 13*a* and 13*b* are connected.

Since the inside circumference of assembly 11 is smaller than its outside circumference, each of panels 13 has an inside width which is slightly less than its outside width. As a result, between inner facing flanges 38*a* and 38*b* (as opposed to between outer facing flanges 33*a* and 33*b*) is a space 70 leading from the inside of assembly 11 into chamber 42.

In assembly, because of the difference in widths between the inner panel portion and the outer panel portion, facing outer flanges of 33*a* and 33*b* adjacent panels 13 seal before inner facing flanges 38*a* and 38*b* do. This assures that the overall assembly 11 is properly resistant to various weather conditions.

Referring still to FIG. 3, panel 13*a* may be formed with a laterally extending channel 41*a* along edge portion 27*a* and panel 13*b* may be formed with a corresponding laterally extending channel 41*b* along edge portion 27*b*. Channels 41*a* and 41*b* are disposed opposite each other when edges 27*a* and 27*b* of panels 31*a* and 31*b* are brought into contact during assembly, and thereby define a laterally extending chamber 42.

Chamber 42 is suitable for retaining a support member or gasket 39, which is used to aid the support of assembly 11. Support member 39 is typically made of a rubber-like material and includes a laterally extending tubular portion 43 and depending arms 45*a* and 45*b* which extend into channels 41*a* and 41*b* respectively. Depending arm 45*a* includes a plurality of ribs 47*a* for pressing against edge portion 27*a* along the area which defines channel 41*a* of panel 13*a*. Similarly, depending arm 45*b* includes a plurality of ribs 47*b* which press against an edge portion 47*b* along the area which defines channel 41*b* of panel 13*b*.

Support member or gasket 43 helps assembly 11 maintain its overall structural configuration when assembled despite most outside forces being exerted thereon, such as high wind conditions or extreme changes in temperature. In particular, it provides for uniform distribution of longitudinal stress along the seams of panels 13.

In addition, during assembly, gasket 43 provides a mating spline to facilitate the alignment and joining of adjacent panels 13.

Furthermore, when adjacent panels 23 are connected, gasket 43 is compressed, which produces a water-tight barrier along the seams of adjacent panels 13.

In order to connect adjacent panels 13 together, a gasket 43 is inserted into laterally extending channel 41*a* of panel 13*a*. Then, panels 13*a* and 13*b* are pushed together by inserting gasket 43 into channel 41*b* of adjacent panel 13*b*. Simultaneously, clamping device 29 is tightened.

Figure 4:
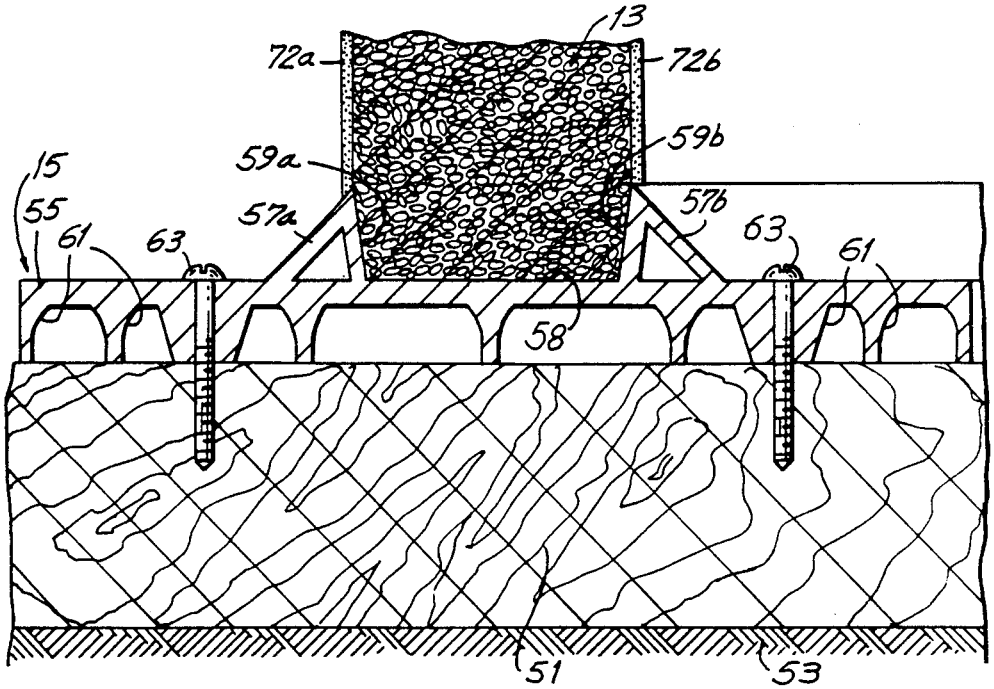
Fig. 4 is an enlarged cross-sectional view showing how the prefabricated structure of the invention is supported on a temporary base assembly.

Turning now to FIG. 4, base assembly 15 which supports assembly 11 is now further described. Base assembly 15 includes a ground member 51 preferably made from a rigid insulating material such as wood. Ground member 51 sits directly on ground 53 and has a diameter and overall circumference slightly larger than the diameter and circumference of assembly 11, as best shown in FIG. 2.

Base assembly 15 further includes an annular base support 55, preferably made of a plastic material such as rigid polyvinylchloride ("PVC"). As shown in FIG. 4, annular base support 55 includes a plurality of cavities 61 which face ground member 51 in assembly and a pair of screws 63 which are anchored in ground member 51 in order to connect annular base support 55 to ground member 51. Corresponding pairs of screws 63 run continuously around annular base support 55 so that all portions of base support 55 are anchored to ground member 51.

Annular base support 55 further includes an annular extending outside triangular support 57*a* and an annular extending inside triangular support 57*b*. Supports 57*a* and 57*b* define an annular channel 58 therebetween which receives and supports panels 13 of assembly 11, as illustrated in FIG. 4. Particularly, triangular support 57*a* includes a surface 59*a* and triangular support 57*b* includes a surface 59*b*. Surfaces 59*a* and 59*b* are in contact with and press against panels 13 so that assembly 11 remains rigid. As shown in FIG. 4, surfaces 59*a* and 59*b* are at a slight angle with the vertical, in order to enhance the pressure applied by triangular members 57*a* and 57*b* on panels 13 of assembly 11.

Although annular base 55 is illustrated in the embodiment described herein, it would only be used for emergency or temporary assembly of the dome-shaped structure. For a more permanent assembly, a concrete footing (a slab or foundation) is used.

When temporarily constructing prefabricated assembly 11, base assembly 15 is first mounted on ground 53 by placing ground member 51 thereon and then connecting base support 55 thereto by means of screws 63 (located along the entire circumference of base assembly 15). Then, panels !3 are mounted on annular base support 55 by fitting the bottoms thereof between annular triangular supports 57*a* and 57*b*. Thereafter, panels 13 are connected to each other by means of clamping devices 29, as described in detail above.

Although it is not necessary to use cement and/or plaster on the interior and exterior surfaces of the assembly panels, if a more permanent structure is desired and in order to make sure building code regulations are met, a cement or plaster base coating may be applied to the walls of the panels, as illustrated in FIG. 4 at 72*a* and 72*b*. A resin or epoxy paint may be applied to the cement or plaster if desired.

Although a clamping device is illustrated as part of the inventive assembly, other connecting devices may be used such as a clip connector or snap connector.

It will thus be seen that the objects set forth above, among those made apparent from the preceding description, are efficiently obtained, and since certain changes may be made in the above assembly without departing from the spirit and scope of the invention, it is intended that all matter contained in the above description and shown in the accompanying drawings shall be interpreted as illustrative and not in a limited sense.

It is also to be understood that the following claims are intended to cover all the generic and specific features of the invention herein described and all statements of the scope of the invention which, as a matter of language, might be said to fall therebetween.

What is claimed:

1. A pre-fabricated modular building assembly comprising:

a plurality of contoured panels, each of said panels having a pair of side edges and an arcuate bottom edge;

means for connecting one of said side edges of one of the panels to one of said side edges of an adjacent panel;

a flexible support member disposed between adjacent panels when said edges of said adjacent panels are coupled together;

wherein said edges of adjacent panels define a channel therebetween when said edges are coupled together for retaining said support members;

wherein said flexible support member is sized and shaped to be compressed within said channel providing a seal between adjacent panels when said edges of said adjacent panels are connected by said connecting means; and wherein said support member includes a tubular portion disposed within said channel.

2. The assembly of claim 1, wherein said support member further includes a plurality of ribs for engaging with said edges of adjacent panels.

3. The assembly of claim 1, wherein said plurality of contoured panels define a substantially hemispherical-shape structure when said panels are connected together.

4. The assembly of claim 1, wherein said connecting means comprises at least one clamp means for positively maintaining said edges of said panels substantially together.

5. The assembly of claim 1, wherein each of said panels include at least one shell disposed adjacent each of said edges; and wherein said connecting means comprises a screw means for maintaining corresponding shells of adjacent panels substantially together.

6. The assembly of claim 5, wherein each of said corresponding shells includes a flange portion, said flange portions of corresponding shells being in substantial contact when the edges of adjacent panels are coupled together.

7. A pre-fabricated modular building assembly comprising:

a plurality of contoured panels, each of said panels having a pair of side edges and an arcuate bottom edge;

means for connecting one of said side edges of one of the panels to one of said side edges of adjacent panel, said connecting means comprising at least one clamp means for positively maintaining such edges of such panels substantially together;

at least one flexible support member disposed between adjacent panels when said edges of said adjacent panels are coupled together;

wherein said at least one flexible support member is sized and shaped to be compressed to provide a seal between adjacent panels when said edges of said adjacent panels are connected by said at least one clamp means; and wherein said edges of adjacent panels define a channel therebetween and said support member includes a tubular portion disposed within said channel.

8. The assembly of claim 7, wherein said support member further includes a plurality of ribs for engaging with said edges of adjacent panels.

9. A pre-fabricated modular building assembly comprising:

a plurality of contoured panels, each of said panels having a pair of side edges and an arcuate bottom edge;

means for connecting one of said side edges of one of the panels to one of said side edges of an adjacent panel;

a support member disposed between adjacent panels when said edges of said adjacent panels are coupled together;

wherein said edges of adjacent panels define a channel therebetween when said edges are coupled together for retaining support member;

wherein said support member includes a tubular portion disposed within said channel.

10. The assembly of claim 9, wherein said support member further includes a plurality of ribs for engaging with said edges of adjacent panels.

11. The assembly of claim 9, wherein said connecting means comprises at least one clamp means for positively maintaining said edges of said panels substantially together.

12. A pre-fabricated modular building assembly comprising:

a plurality of contoured panels, each of said panels having a pair of side edges and an arcuate bottom edge;

means for connecting one of said side edges of one of the panels to one of said side edges of an adjacent panel;

means for supporting said panels in a substantially upright position;

wherein each of said panels further includes an outer wall, an inner wall and a bottom portion;

wherein said supporting means comprises an annular support frame disposed beneath said bottom portions of said panels, said annular support frame including means for pressing against the outer wall of each of the panels and means for pressing against the inner wall of each of the panels, said outer and inner wall pressing means comprising annular extending triangular members disposed above said annular support frame.

13. The assembly of claim 12 wherein said means for supporting said panels further comprises a substantially circular base on which said annular support frame is mounted.

14. The assembly of claim 13, wherein said annular support frame includes a plurality of screw members for connecting said frame to said base.

* * * * *